US006879222B2

(12) United States Patent
Vangala et al.

(10) Patent No.: US 6,879,222 B2
(45) Date of Patent: Apr. 12, 2005

(54) REDUCED LENGTH METALLIZED CERAMIC DUPLEXER

(75) Inventors: Reddy Vangala, Albuquerque, NM (US); Glenn Rice, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 0 days.

(21) Appl. No.: 10/076,053

(22) Filed: Feb. 14, 2002

(65) Prior Publication Data

US 2003/0151468 A1 Aug. 14, 2003

(51) Int. Cl.[7] ..... H01P 5/12
(52) U.S. Cl. ..... 333/134; 333/202; 333/207
(58) Field of Search ..... 333/134, 202, 333/203, 206, 207

(56) References Cited

U.S. PATENT DOCUMENTS

| | | | | | |
|---|---|---|---|---|---|
| 4,431,977 | A | | 2/1984 | Sokola et al. | |
| 4,602,229 | A | | 7/1986 | Yester, Jr. et al. | |
| 4,742,562 | A | | 5/1988 | Kommrusch | |
| 5,177,458 | A | | 1/1993 | Newell et al. | |
| 5,191,305 | A | * | 3/1993 | Frost et al. | 333/202 |
| 5,262,742 | A | * | 11/1993 | Bentivenga | 333/203 |
| 5,446,729 | A | * | 8/1995 | Jachowski | |
| 5,488,335 | A | | 1/1996 | Agahi-Kesheh et al. | |
| 5,537,085 | A | | 7/1996 | McVeety | |
| 5,563,561 | A | * | 10/1996 | Ishihara et al. | 333/206 |
| 5,576,672 | A | * | 11/1996 | Hirai et al. | 333/204 |
| 5,745,018 | A | | 4/1998 | Vangala | |
| 5,790,001 | A | * | 8/1998 | Waldo et al. | 333/202 |
| 6,057,746 | A | * | 5/2000 | Ito | 333/134 |
| 6,107,227 | A | | 8/2000 | Jacquin et al. | |
| 6,242,376 | B1 | | 6/2001 | Jacquin et al. | |
| 6,472,953 | B1 | * | 10/2002 | Sakuragawa et al. | 333/133 |
| 6,677,837 | B2 | * | 1/2004 | Kojima et al. | 333/208 |
| 2002/0030559 | A1 | * | 3/2002 | Hideyuki et al. | |

FOREIGN PATENT DOCUMENTS

| | | | | |
|---|---|---|---|---|
| JP | 05275905 A | * | 10/1993 | H01P/1/213 |
| WO | WO 97 02618 | * | 1/1997 | |
| WO | WO 00/77883 A1 | | 12/2000 | |

OTHER PUBLICATIONS

U.S. Appl. No. 10/080,338, filed Feb. 2002, Matthews.
U.S. Appl. No. 10/080,354, filed Feb. 2002, Rogozine et al.

* cited by examiner

*Primary Examiner*—Robert Pascal
*Assistant Examiner*—Kimberly E Glenn
(74) *Attorney, Agent, or Firm*—Steven Weseman

(57) ABSTRACT

A duplexing communication signal filter has a substantially U-shaped core of dielectric material including a transmit arm, a receive arm and a base portion joining the transmit arm to the receive arm. Both the transmit arm and the receive arm each define a series of through-hole resonators. Present on the core of dielectric material is a surface-layer pattern of metallized and unmetallized areas. The pattern includes a wide area of metallization for providing off-band signal absorption, a first unmetallized area surrounding a plurality of the through-hole openings of the transmit arm, a second contiguous unmetallized area surrounding a plurality of the through-hole openings of the receiver arm, a transmitter pad metallized area on the transmit arm, a receiver pad metallized area on the receive arm, and an antenna pad metallized area.

17 Claims, 14 Drawing Sheets

FIG. 10
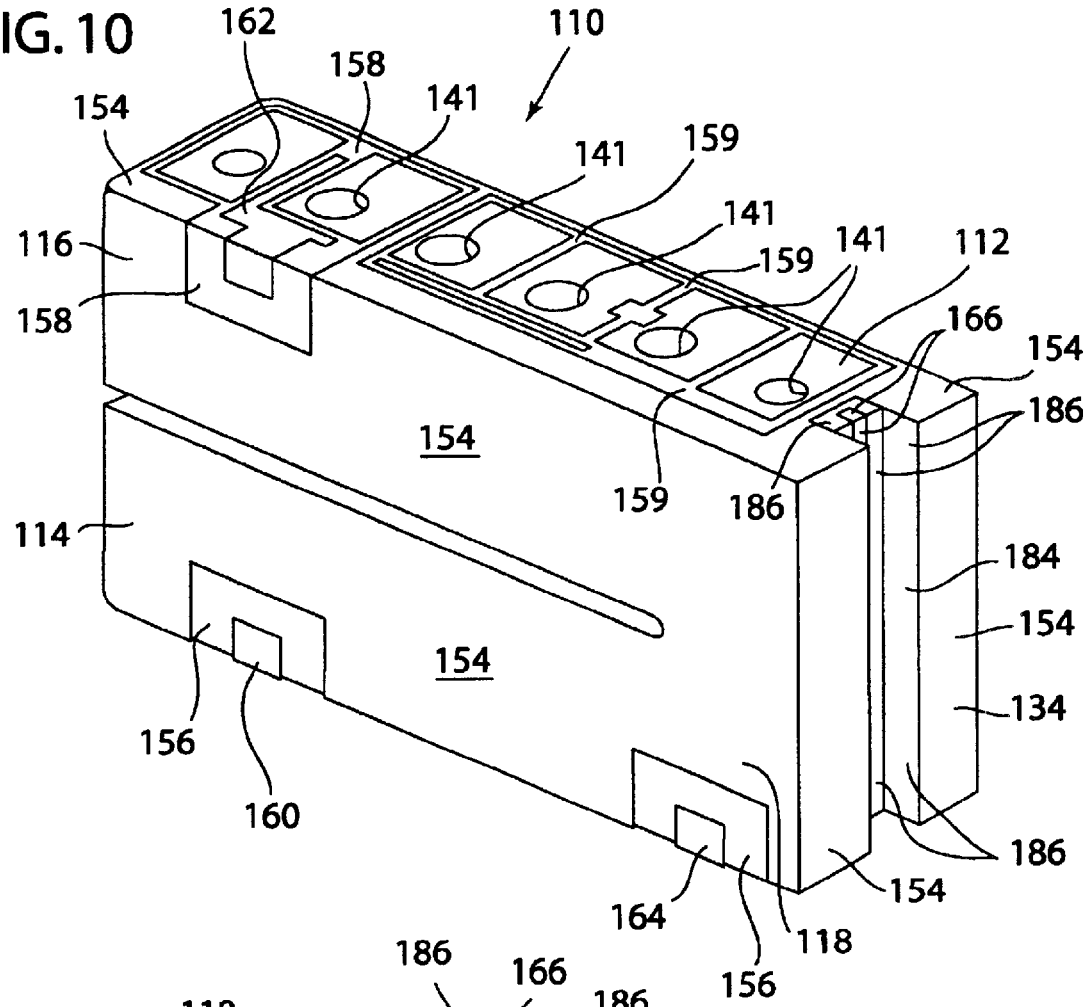
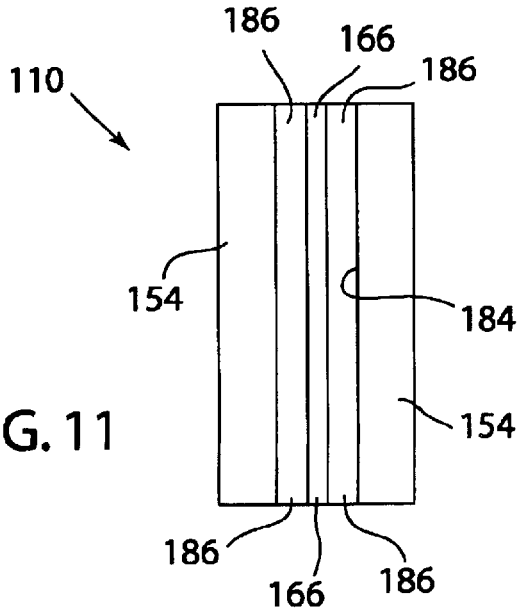
FIG. 11

REDUCED LENGTH METALLIZED CERAMIC DUPLEXER

TECHNICAL FIELD

This invention relates to dielectric block filters for radio-frequency signals, and in particular, to dielectric block resonators suitable for use in filtering signals generated in wireless communication applications.

BACKGROUND

Ceramic block filters offer several advantages over lumped component filters. The blocks are relatively easy to manufacture, rugged, and relatively compact. In the basic ceramic block filter design, the resonators are formed by typically cylindrical passages, called holes, extending through the block from the long narrow side to the opposite long narrow side. The block is substantially plated with a conductive material (i.e. metallized) on all but one of its six (outer) sides and on the side walls of the resonator holes.

One of the two opposing sides containing through-hole openings is not fully metallized, but instead bears a metallization pattern designed to couple input and output signals through the series of resonators. This patterned side is conventionally labeled the top of the block. In some designs, the pattern may extend to sides of the block, where input/output electrodes are formed.

The reactive coupling between adjacent resonators is affected, at least to some extent, by the physical dimensions of each resonator, by the orientation of each resonator with respect to the other resonators, and by aspects of ceramic composition. Interactions of the electromagnetic fields within and around the block are complex and difficult to predict.

These filters may also be equipped with an external metallic shield attached to and positioned across the open-circuited end of the block in order to cancel parasitic coupling between non-adjacent resonators and other nearby radio-frequency (RF) application components.

Although such RF signal filters have received widespread commercial acceptance since the 1980s, efforts at improvement on this basic design continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels. These trends are pushing the limits of filter technology to provide sufficient frequency selectivity and band isolation.

Coupled with the higher frequencies and crowded channels are the consumer market trends towards ever smaller wireless communication devices (e.g., handsets) and longer battery life. Combined, these trends place difficult constraints on the design of wireless components such as filters. Filter designers may not simply add more space-taking resonators or allow greater insertion loss in order to provide improved signal rejection.

The desired forms and circuit board layouts of portable communication devices vary widely with ever smaller dimensions being the general trend. A challenge in RF ceramic block filter design is providing filters with reduced dimensions. Many communication-device forms dictate not only the overall filter size but also individual filter dimensions. For example, the height of a ceramic filter as measured from the surface mounted side is conventionally limited. The allowable block length or maximum linear dimension is also a challenge for filters in certain RF devices, such as especially narrow wireless handsets.

The need is ongoing for reduced size ceramic block filters that meet demanding filtering performance specifications without significantly increasing manufacturing costs.

SUMMARY

The invention described here overcomes limitations of the prior art by providing a reduced length RF dielectric filter.

An embodiment of the invention is a duplexing communication signal filter suitable for use in a mobile communication device and connection to an antenna, a transmitter and a receiver for filtering an incoming signal from the antenna to the receiver and for filtering an outgoing signal from the transmitter to the antenna. The duplexing filter comprises a substantially U-shaped core of dielectric material including a transmit arm, a receive arm and a base portion joining the transmit arm to the receive arm. Each arm has an inwardly facing surface and an outwardly facing surface. Both the transmit arm and the receive arm each define a series of through-holes. Each through-hole extends through the respective arms between an opening on the inwardly facing surface and an opening on the outwardly facing surface.

Present on the core of dielectric material is a surface-layer pattern of metallized and unmetallized areas. The pattern includes a wide area of metallization for providing off-band signal absorption, a first contiguous unmetallized area surrounding a plurality of the through-hole openings on the outwardly facing surface of the transmit arm, a second contiguous unmetallized area surrounding a plurality of the through-hole openings on the outwardly facing surface of the receiver arm, a transmitter pad metallized area on the transmit arm for receiving the outgoing signal, a receiver pad metallized area on the receive arm for providing the incoming signal, an antenna pad metallized area for receiving the incoming signal and outputting the outgoing signal, and a bridge metallized area extending between the transmit arm and the receive arm.

In an alternate embodiment of the present invention the filter includes first and second rigid cores of dielectric material joined together. Each core has a substantially rectangular parallelepided shape with a top surface, a bottom surface and four side surfaces and each core defining a series of through-holes. Each through-hole extends from an opening on the top surface to an opening on the bottom surface.

A first surface-layer pattern of metallized and unmetallized areas is present on the first core. The first pattern includes a first wide area of metallization for providing off-band signal absorption, a first contiguous unmetallized area substantially surrounding at least two of the openings on the top surface of the first core, a first bridge electrode extending between the top surface and the bottom surface, and a transmitter connection pad of metallization for receiving the outgoing signal.

A second surface-layer pattern of metallized and unmetallized areas is present on the second core. The second pattern includes a second wide area of metallization for providing off-band signal absorption, a second contiguous unmetallized area substantially surrounding at least two of the openings on the top surface of the second core, a second bridge electrode extending between the top surface and the bottom surface and a receiver connection pad of metallization for providing the incoming signal.

An antenna connection pad is optionally either part of the first pattern and on the first core or on the second pattern and on the second core, with the first core being the preferred location. The first and second bridge electrodes are linked to provide a signal path between the top surfaces of each core. A bond is provided between each bottom surface for joining the first core and the second core. The first and second wide areas of metallization are preferably conductively linked.

BRIEF DESCRIPTION OF THE FIGURES

In the FIGURES,

FIG. 10 is a perspective view of a duplexing communication filter according to an alternate embodiment of the invention;

FIG. 11 is a view of the grooved side of the filter of FIG. 10;

DETAILED DESCRIPTION OF PREFERRED EMBODIMENTS

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
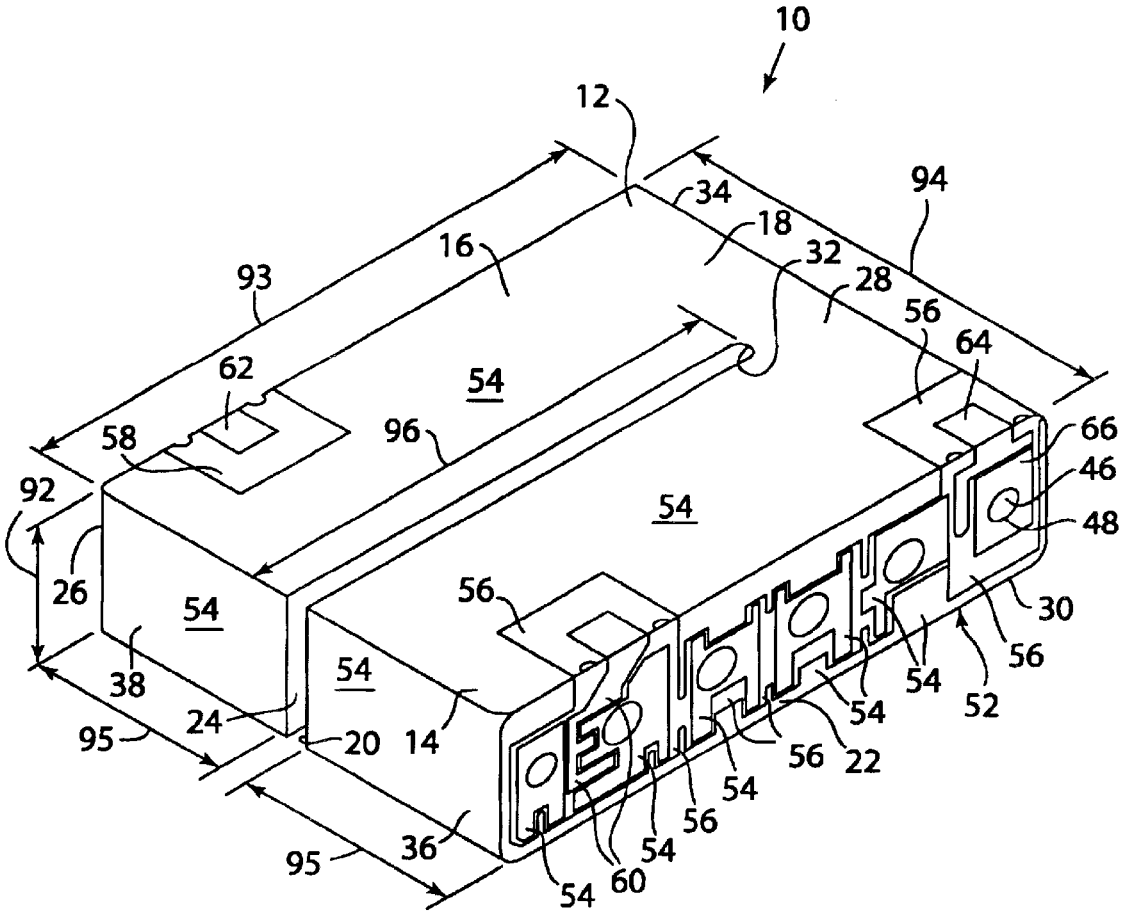
FIG. 1 is an enlarged, perspective view of a duplexing communication filter according to the invention, shown with the surface mountable side facing up and revealing the portion of the metallization pattern on the outwardly facing surface of the transmit arm.
Figure 2:
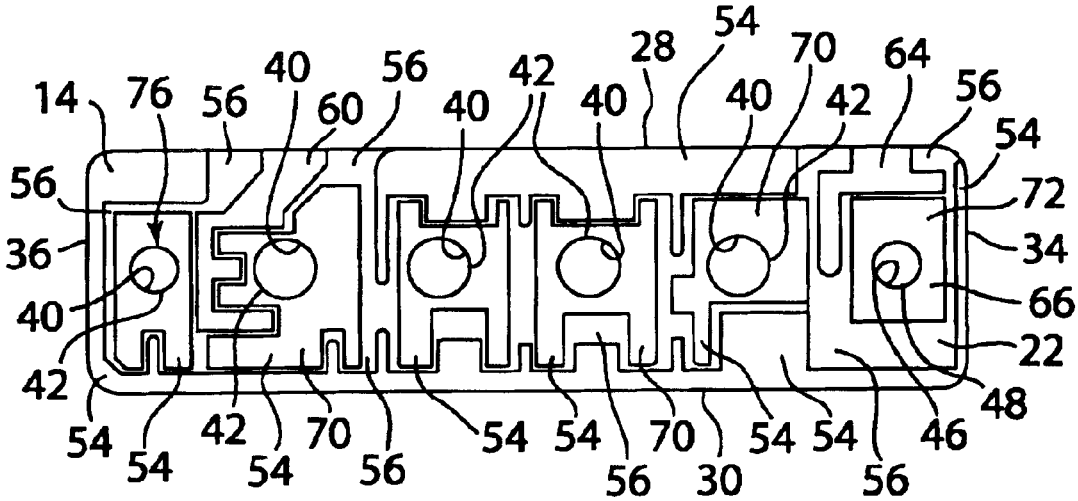
FIG. 2 is a side view of the outwardly facing surface of the transmit arm of the filter of FIG. 1.
Figure 3:
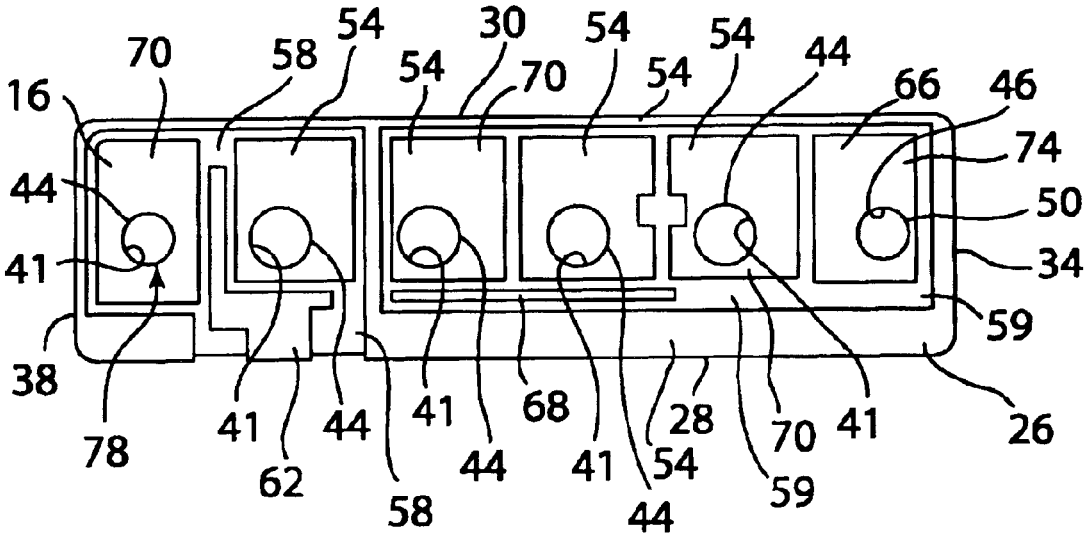
FIG. 3 is a side view of the outwardly facing surface of the receive arm of the filter of FIG. 1.

Referring to FIGS. 1 through 3, a duplexing communication filter 10 comprises a core of dielectric material 12 having a transmit arm 14, a receive arm 16 and a base portion 18. Transmit arm 14 has an inwardly facing surface 20 and an outwardly facing surface 22. Likewise, receive arm 16 has an inwardly facing surface 24 and an outwardly facing surface 26. In FIG. 1, filter 10 is shown in an orientation such that surface mountable side 28 is facing upwardly and the opposite side 30 faces down.

Figure 4:
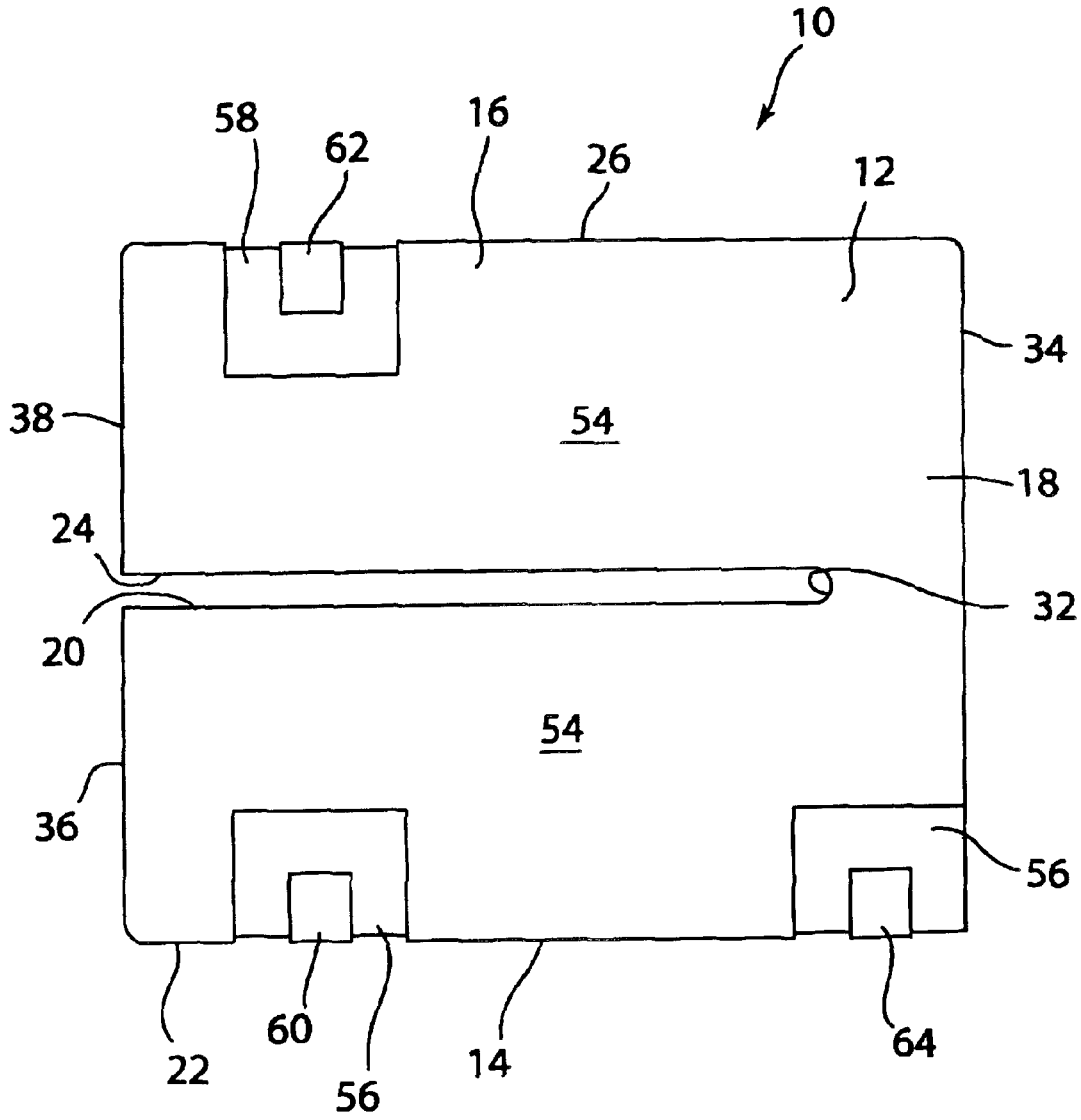
FIG. 4 is a side view of the surface mountable side of the filter of FIG. 1.
Figure 5:
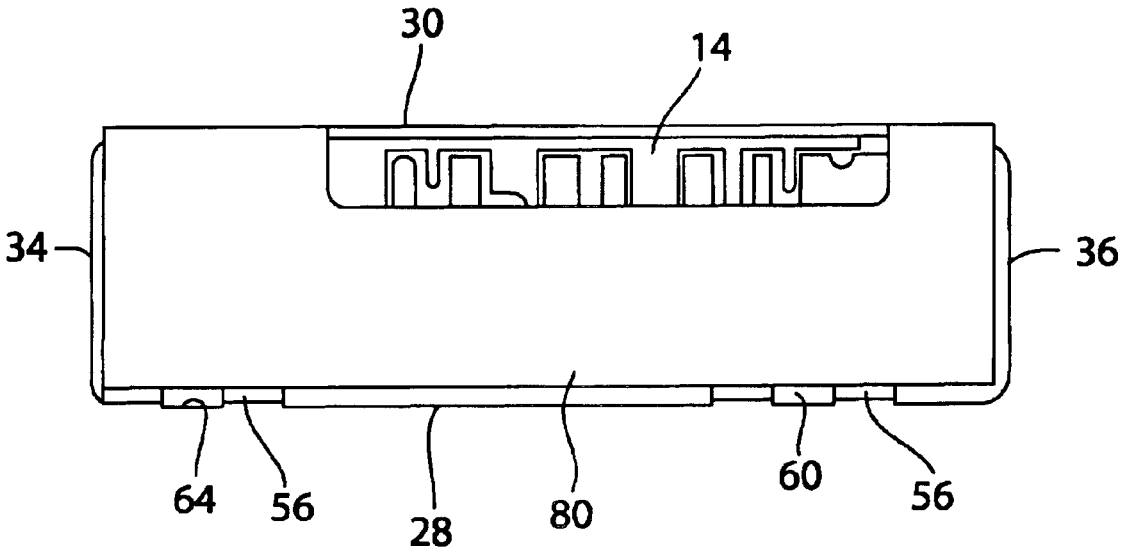
FIG. 5 is a view of the outwardly facing surface of the transmit arm of the filter of FIG. 1 but shown with a metal shield.
Figure 6:
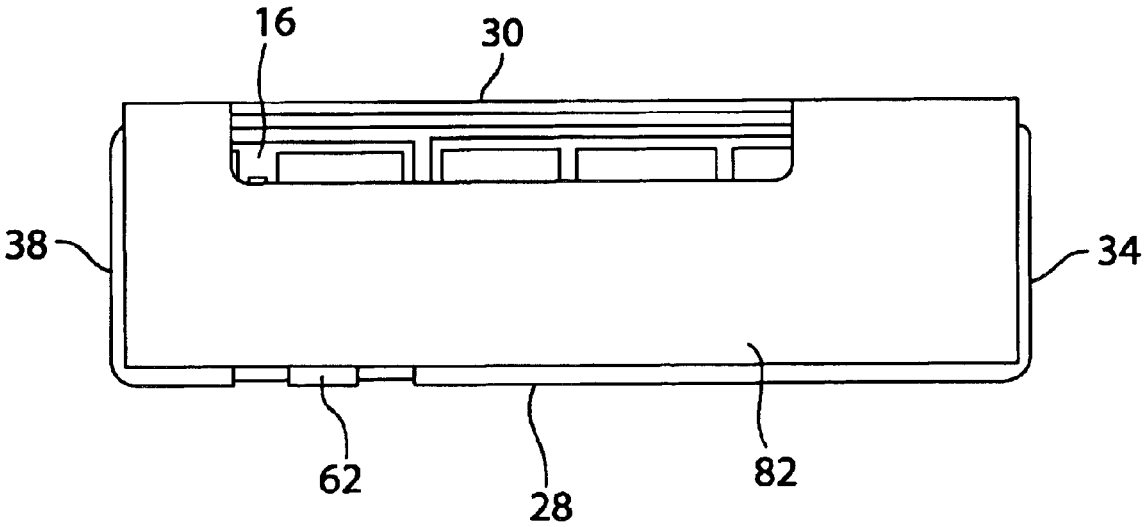
FIG. 6 is a view of the outwardly facing surface of the receive arm of the filter of FIG. 1 but shown with a metal shield.
Figure 7:
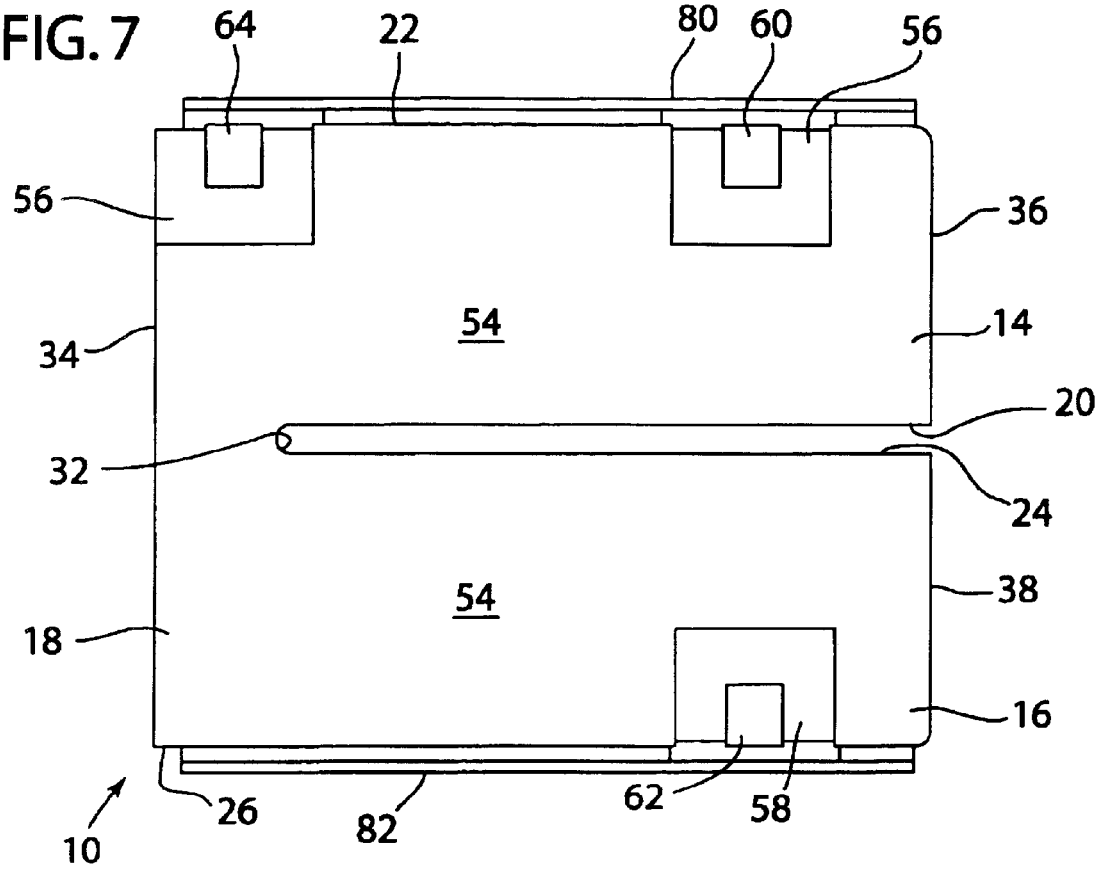
FIG. 7 is a view of the surface-mountable side of the filter of FIG. 1 but shown with interference shields for the outwardly facing surfaces of the transmit arm and the receive arm.
Figure 8:
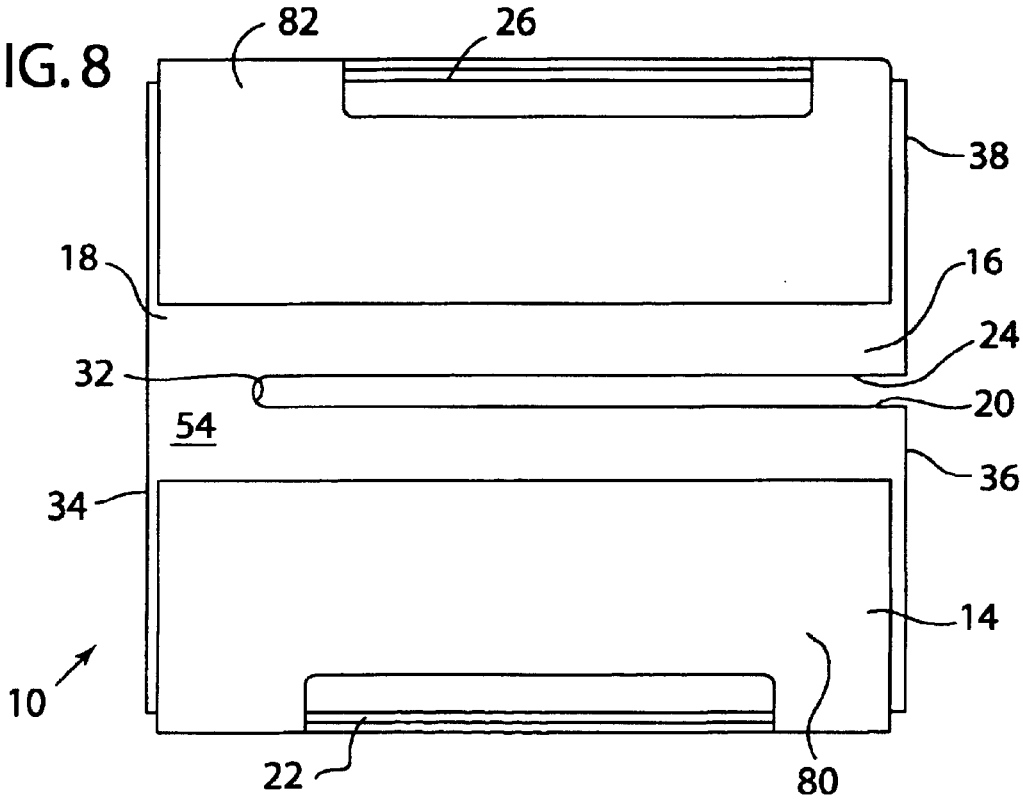
FIG. 8 is a view of the side opposite to that shown in FIG. 7.

FIG. 4 is a view of side 28 illustrating an exemplary surface mount footprint.

Base portion has an inner surface 32 and an outwardly facing surface 34. Inner surface 32 extends between inwardly facing surface 20 and inwardly facing surface 24. Outwardly facing surface 34 extends between outwardly facing surfaces 22 and 26. Opposite base portion 18 transmit arm 14 and receive arm 16 have respective surfaces 36 and 38.

Each arm (14 and 16) of core 12 defines a series of through-holes 40 and 41, respectively. Arm 14 defines through-holes 40 extending from openings 42 at outwardly facing surface 22 to openings 45 (FIG. 9) at inwardly facing surface 20. Arm 14 defines through-holes 41 extending from openings 44 at outwardly facing surface 26 to openings 47 (FIG. 9) at inwardly facing surface 24. Core 12 also preferably defines a relatively longer through-hole 46 extending from an opening 48 at top surface 22 of transmit arm 14 to an opening 50 at top surface 26 of receive arm 16 and through base portion 18.

Core 12 is rigid and is preferably made of a ceramic material selected for mechanical strength, dielectric properties, plating compatibility, and cost. The preparation of suitable dielectric ceramics is described in U.S. Pat. No. 6,107,227 to Jacquin et al. and U.S. Pat. No. 6,242,376, the disclosures of which are hereby incorporated by reference to the extent they are not inconsistent with the present teachings. Core 12 is preferably prepared by mixing separate constituents in particulate form (e.g., $Al_2O_3$, $TiO_2$, $Zr_2O_3$) with heating steps followed by press molding and then a firing step to react and Inter-bond the separate constituents.

Filter 10 includes a pattern 52 of metallized and unmetallized areas. Pattern 52 includes a wide area of contiguous metallization 54, a first contiguous unmetallized area 56, a second contiguous unmetallized area 58, a third contiguous unmetallized area 59, a transmitter metallized connection pad 60, a receiver metallized connection pad 62, an antenna metallized connection pad 64, a bridge metallized area 66, and a bypass electrode (or strip) 68.

Wide area of metallization 54 extends over substantially all of inwardly facing surfaces 20, 24 and 32, top surface 30, bottom surface 28, and side surfaces 34, 36 and 38. Wide area of metallization 54 also extends over the inner side walls of through-holes 40 and 41 terminating at pads 70 at openings 42 and 44. Wide metallization area 54 is contiguous such that all portions thereof are conductively linked.

First contiguous unmetallized area 56 surrounds a plurality of the openings 42 on outwardly facing surface 22 of transmit core 14, while second contiguous unmetallized area 58 surrounds a plurality of openings 44 on outwardly facing surface 26. In preferred embodiments, the through-hole openings 42, 44 and 46 have adjacent metallized portions (or pads 70, 72 and 74) which are part of the wide area of metallization 54. Metallized portions are offset and isolated from one another by unmetallized areas such as area 56.

To provide a signal path between transmit arm 14 and receive arm 16, pattern 54 includes a bridge metallized area 66 extending between outwardly facing surface 22 and outwardly facing surface 26. More specifically, bridge metallization area 66 extends from a pad 72 through through-hole 46 to a pad 74. Pad 72 is isolated but capacitively coupled to other parts of pattern 52 by a portion of unmetallized area 56. Pad 74 is similarly surrounded by a portion of unmetallized area 59.

Transmit arm 14 includes a through-hole and portions of pattern 52 forming a trap resonator 76. Trap resonators, such as resonator 76, are configured to produce a zero, or attenuation pole, in the transfer function of the filter. To serve as a frequency trap, the resonator is located adjacent transmitter electrode 60 but opposite the array of spaced-apart resonators 40 which extend between bridge electrode 66 and transmitter electrode 60. More specifically, trap resonator 76 is positioned between transmitter electrode 60 and end 36 of arm 14.

Receive arm 16 includes a through-hole and portions of pattern 52 forming a trap resonator 78. Outwardly facing surface 26 of receive arm 16 includes a stripshaped metallization area 68 (part of pattern 52), which is thought to reduce insertion loss and improve off-frequency signal rejection by approximating a parallel resonant circuit between non-adjacent resonators.

To facilitate the surface mounting of filter 10 to an external printed circuit board or substrate, pattern 52 includes a transmitter metallized connection pad 60, receiver metallized connection pad 62 and antenna metallized connection pad 64, which are surrounded by respective unmetallized areas 56, 58 and 59.

The metallized areas of pattern 52 preferably comprise a coating of one or more layers of a conductive metal. A silver-bearing conductive layer is presently preferred. Suitable thick film silver-bearing conductive pastes are commercially available from The Dupont Company's Microcircuit Materials Division.

The surface-layer pattern of metallized and unmetallized areas 52 on core 12 may be prepared by providing a rigid core of dielectric material including through-holes to predetermined dimensions. The outer surfaces and through-hole side walls are coated with one or more metallic film layers by dipping, spraying or plating.

The pattern of metallized and unmetallized areas is then preferably completed by computer-automated laser ablation of designated areas on core 12. This laser ablation approach results in unmetallized areas which are not only free of metallization but also recessed into the surfaces of core 12 because laser ablation removes both the metal layer and a slight portion of the dielectric material.

Alternatively, selected surfaces of the fully metallized core precursor are removed by abrasive forces such as particle blasting resulting in one or more unmetallized surfaces. The pattern of metallized and unmetallized areas is then completed by pattern printing with thick film metallic paste.

Referring now to FIGS. 5 through 8, preferred embodiments of the present invention include shields 80 and 82, which are thought to prevent spurious, undesired transmission of signals to and from signal filter 10 and undesired interference among resonators 40, 76 and 78. Shields 80 and 82 are preferably relatively thin metal sheets bonded to filter 10 at portions of wide area of metallization 52. For a discussion of metal shield configurations, see U.S. Pat. No. 5,745,018 to Vangala, the relevant disclosure of which is incorporated herein by reference.

Figure 9:
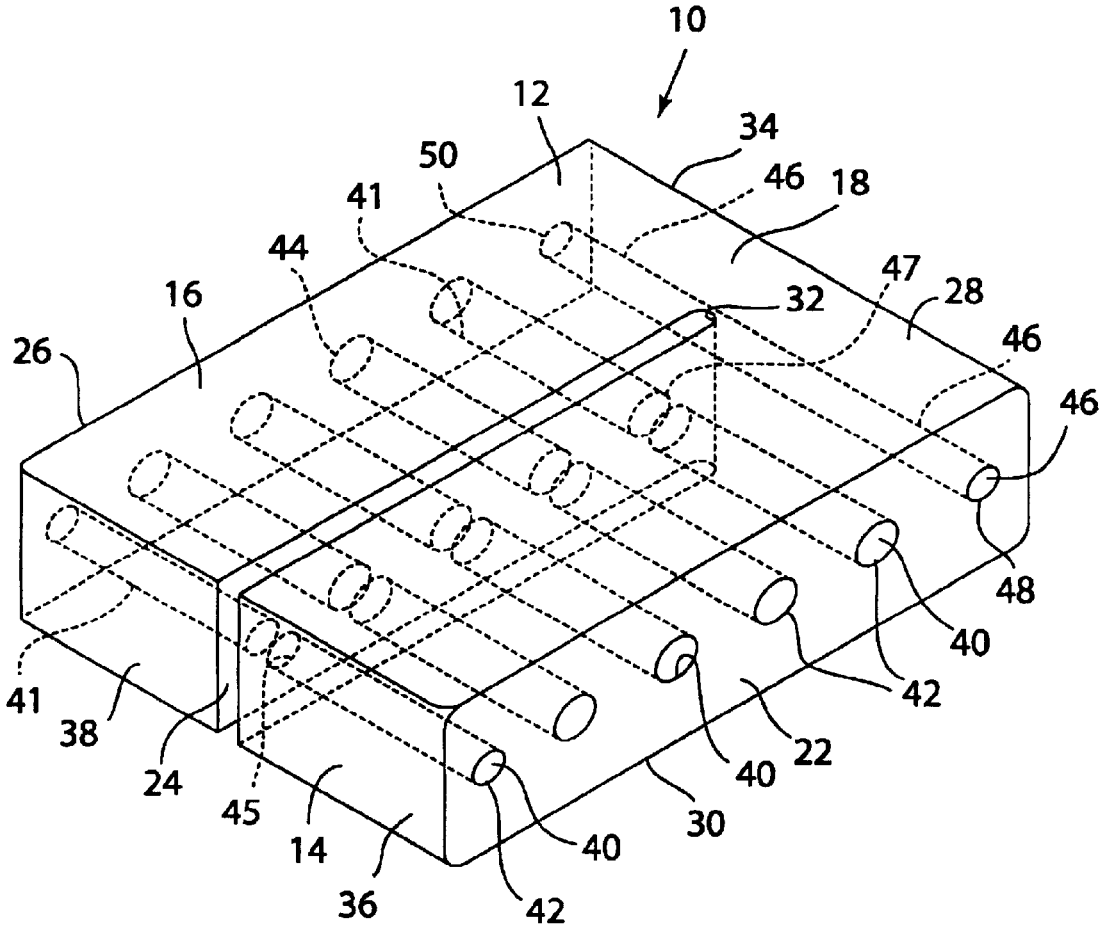
FIG. 9 is a schematic perspective view revealing exemplary positions of the through-holes of a duplexing communication filter according to the present invention.

FIG. 9 is a schematic isometric view demonstrating a possible arrangement of the through-holes defined in the transmit and the receive arms. The embodiment shown in FIG. 9 has through-holes 40 of transmit arm 14 substantially aligned with through-holes 41 of receive arm 16. This aligned arrangement simplifies manufacturing of core 12. Embodiments in which through-holes of transmit arm 14 are not aligned with the through-holes of receive arm 16 are also contemplated. An unaligned arrangement allows more circuit design flexibility.

An embodiment of this invention featuring an alternate configuration for the bridge metallized area signal path 166 between the transmit arm and the receive arm is shown in FIGS. 10 and 11. A signal filter 110 comprises a dielectric core 112 and a pattern of metallized and unmetallized areas 152. Core 112 Includes a transmit arm portion 114, a receive arm portion 116 and a base portion 118. Core 112's structure defines a first array of through-holes (not separately shown) in transmit arm 114 and a second array of through-holes 141 in receive arm 116. Extending across outwardly facing surface 134 of base portion 118 is a groove 184.

Metallization pattern 152 includes a wide-area of metallization 154, unmetallized areas 156, 158, 159 and 186, a transmitter connection pad metallized area 160, a receiver connection pad metallized area 162 and an antenna connection pad metallized area 164, and a bridge electrode 166 in groove 184. Bridge electrode 166 has portions relatively near antenna pad 164 and provides a signal path between transmit arm 114 and receive arm 116.

Figure 12:
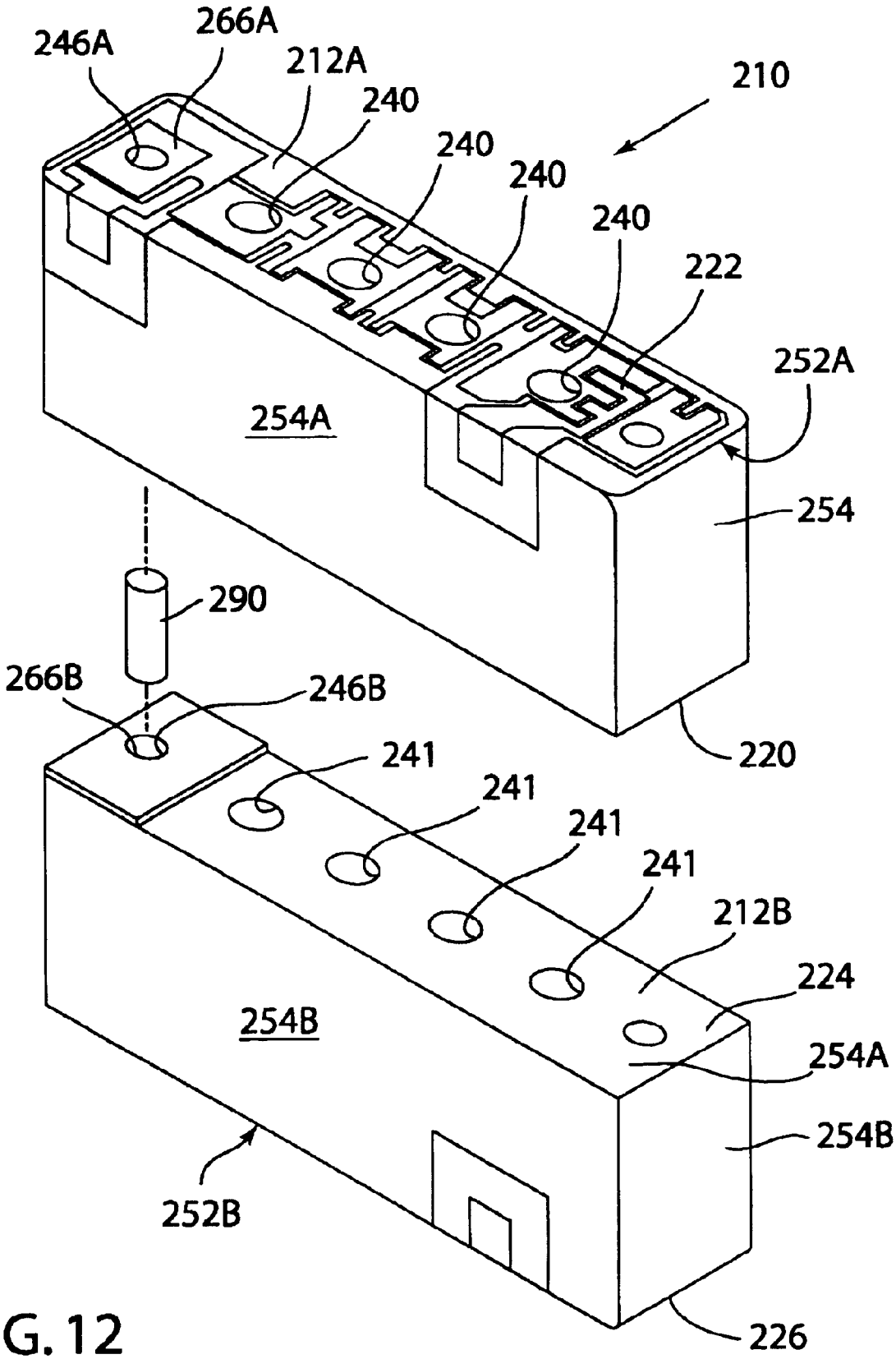
FIG. 12 is an exploded perspective view of a duplexing communication filter according to an alternate embodiment of the invention.

An embodiment of this invention featuring two cores bonded together to provide a duplexing communication filter is shown in FIG. 12. Filter 210 comprises a first core of dielectric material 212A, a second core of dielectric material 212B, an insert 290, a first pattern of metallized and unmetallized areas 252A on first core 212A, and a second pattern of metallized and unmetallized areas 252B on second core 212B.

First core 212A's structure defines a series of through-holes 240, and second core 212B likewise includes a series of through-holes 241. Insert 290 is adapted for insertion into alignable through-holes 246A and 246B defined in first core 212A and second core 212B, respectively.

Present on first core 212A is a first pattern of metallized and unmetallized areas 252A. Present on second core 212B is a second pattern of metallized and unmetallized areas 252B.

First core 212A and second core 212B are joined by a bond between first core bottom surface 220 and second core bottom surface 224. First pattern 252A includes a wide area of metallization 254A. Second pattern 252B also includes a wide area of metallization, identified in FIG. 12 by reference numeral 254B.

Pattern 252A includes a first bridge electrode 266A extending from top surface 222 to bottom surface 220 and is positioned over the side walls of through hole 246A. Pattern 252B includes a second bridge electrode 266B extending from top surface 226 to bottom surface 224 of core 212B and is positioned over the side walls of through-hole 246B.

When first and second cores (212A and 212B) are joined together, bridge electrodes 266A and 266B together form a signal path between outwardly facing surface 222 of first core 212A and outwardly (or top) facing surface 226 of second core 212B.

Filter 210 preferably includes an insert 290 which serves to conductively link first bridge electrode 266A to second bridge electrode 266B. Insert 290 also adds physical strength to the bond between first core 212A and second core 212B. Metallization areas 254A and 254B are also preferably conductively linked to form a common local ground potential for filter 210.

The filter preferably has a length of at most about 17 millimeters, a maximum linear dimension of at most about 17 millimeters, and a surface mount height of at most about 4 millimeters.

Figure 13:
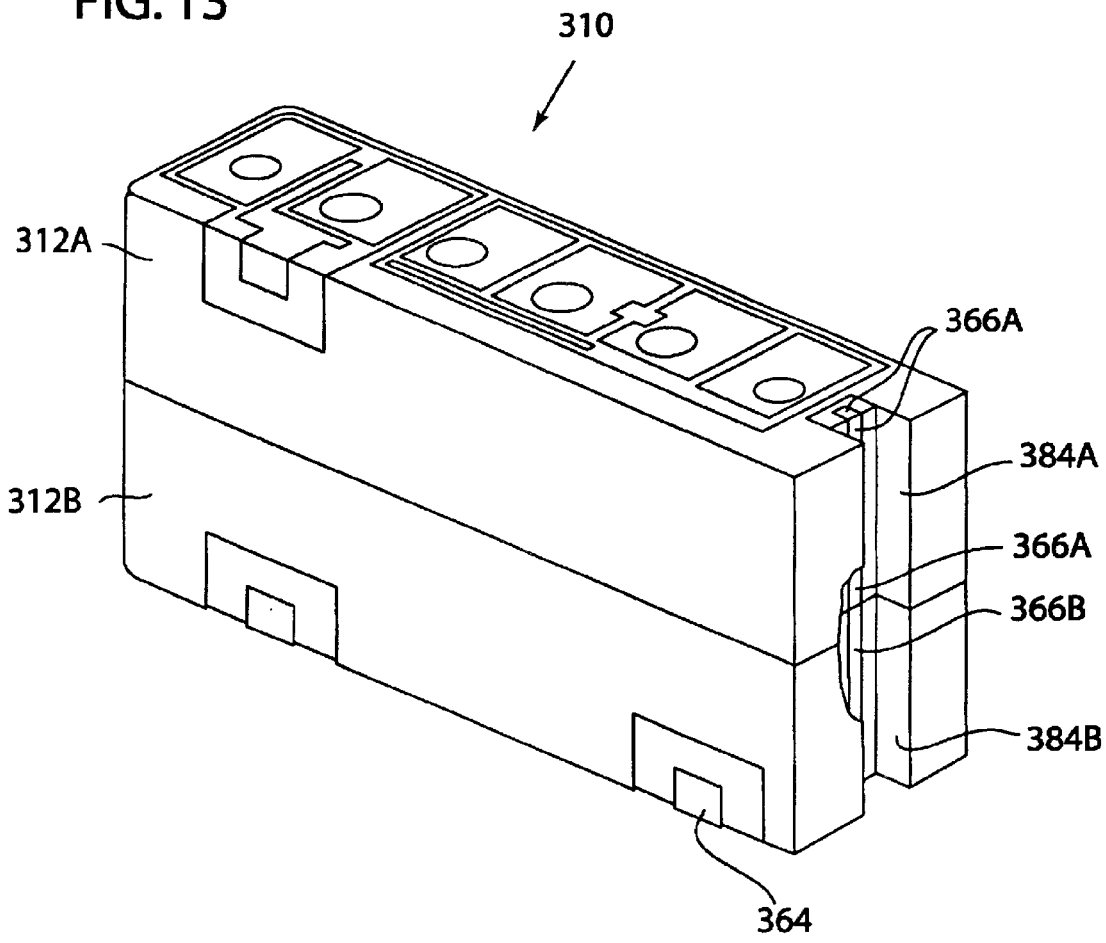
FIG. 13 is a perspective view of a duplexing communication filter according to an alternate embodiment of the invention.

The in-groove bridge electrode feature shown in FIGS. 10 and 11 is applicable to the joined-two core configuration of FIG. 12. This combination of inventive features is shown in FIG. 13 for a filter designated 310. Filter 310 includes a first core 312A having a first surface groove 384A bearing a first bridge electrode 366A and second core 312B having a second surface groove 384B axially aligned with the first surface groove 384A and bearing a second bridge electrode 366B. Bridge electrodes 366A and 366B are conductively linked to provide a signal path near antenna connection pad 364.

Figure 14:
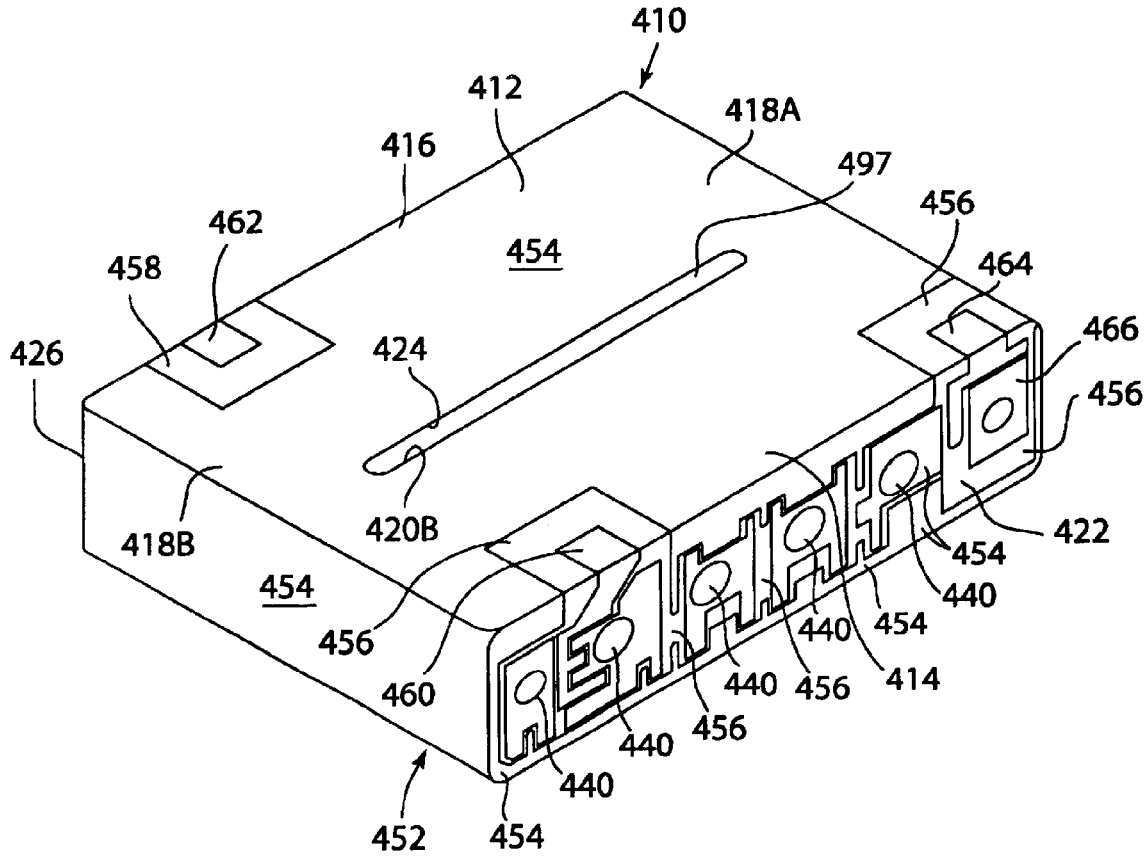
FIG. 14 is a perspective view of a duplexing communication filter according to another alternate embodiment of the invention.
Figure 15:
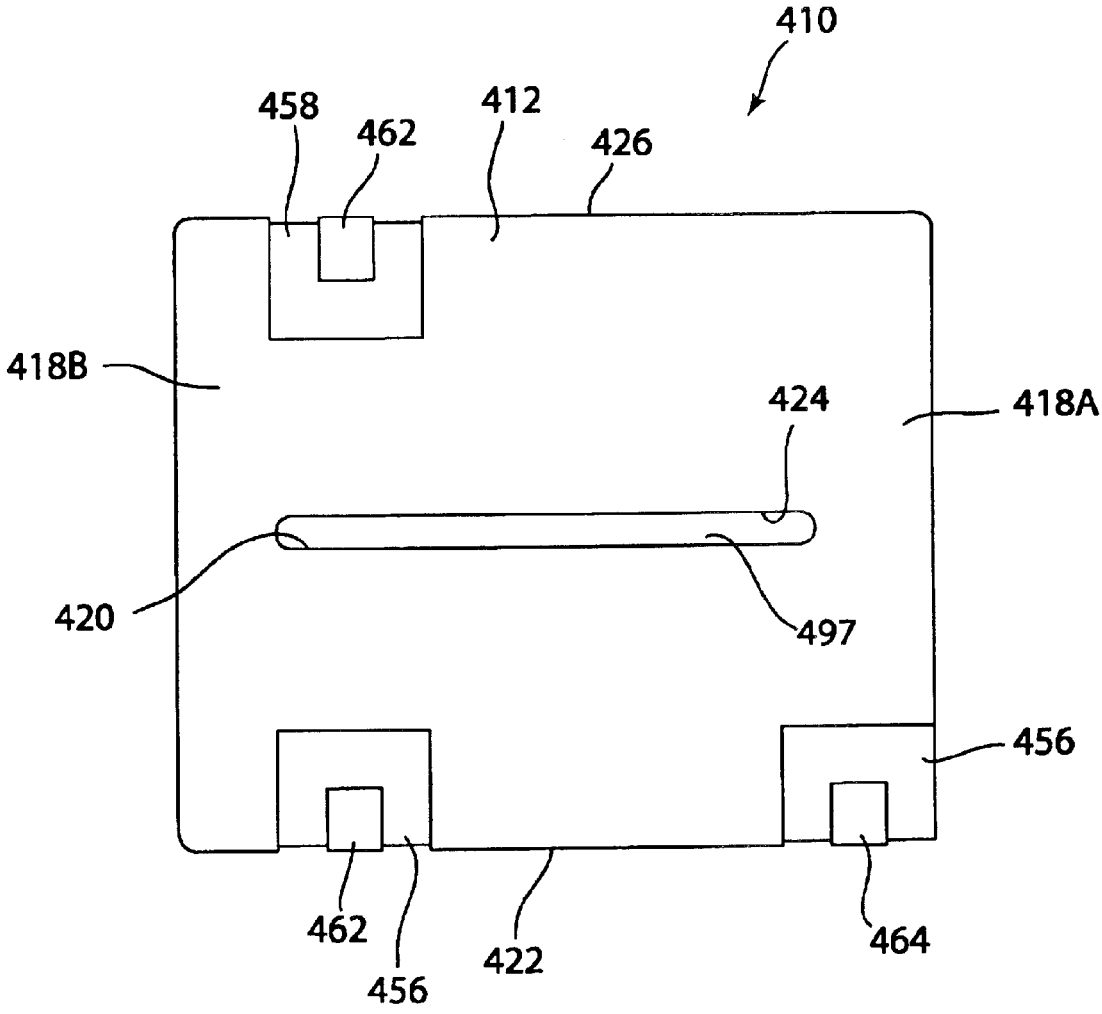
FIG. 15 is a side view of the surface mountable side of the filter of FIG. 14.

An embodiment of this invention offering a durable core structure and simpler core fabrication is shown In FIGS. 14 and 15. Signal filter 410 includes a dielectric core 412 having a first, transmit arm portion 414, a second, receive arm portion 416, and opposing base portions 418A and 418B. Present on core 412 is a pattern of metallized and unmetallized areas 452. Core 412's structure defines a first array of through-holes 440 in transmit arm 414 and a second array of through-holes (not separately shown) in receive arm 416.

The structure of core 412 is simple to manufacture in that it can be described as a substantially rectangular parallelepiped shaped core of rigid dielectric material defining a slot 497 dividing core 412 into a transmit branch 414 and a receive branch 416 such that each branch has an inwardly facing surface 420, 424 and an outwardly facing surface 422, 426.

Metallization pattern 452 includes a wide area of contiguous metallization 454, a first unmetallized area 456, a second contiguous unmetallized area 458, a transmitter metallized connection pad 460, a receiver metallized connection pad 462, an antenna metallized connection pad 464 and a bridge metallized area 466.

To provide a signal path between transmit branch 414 and receive branch 416, pattern 454 includes a bridge metallized area 466 extending between outwardly facing surface 422 and outwardly facing surface 426.

Figure 16:
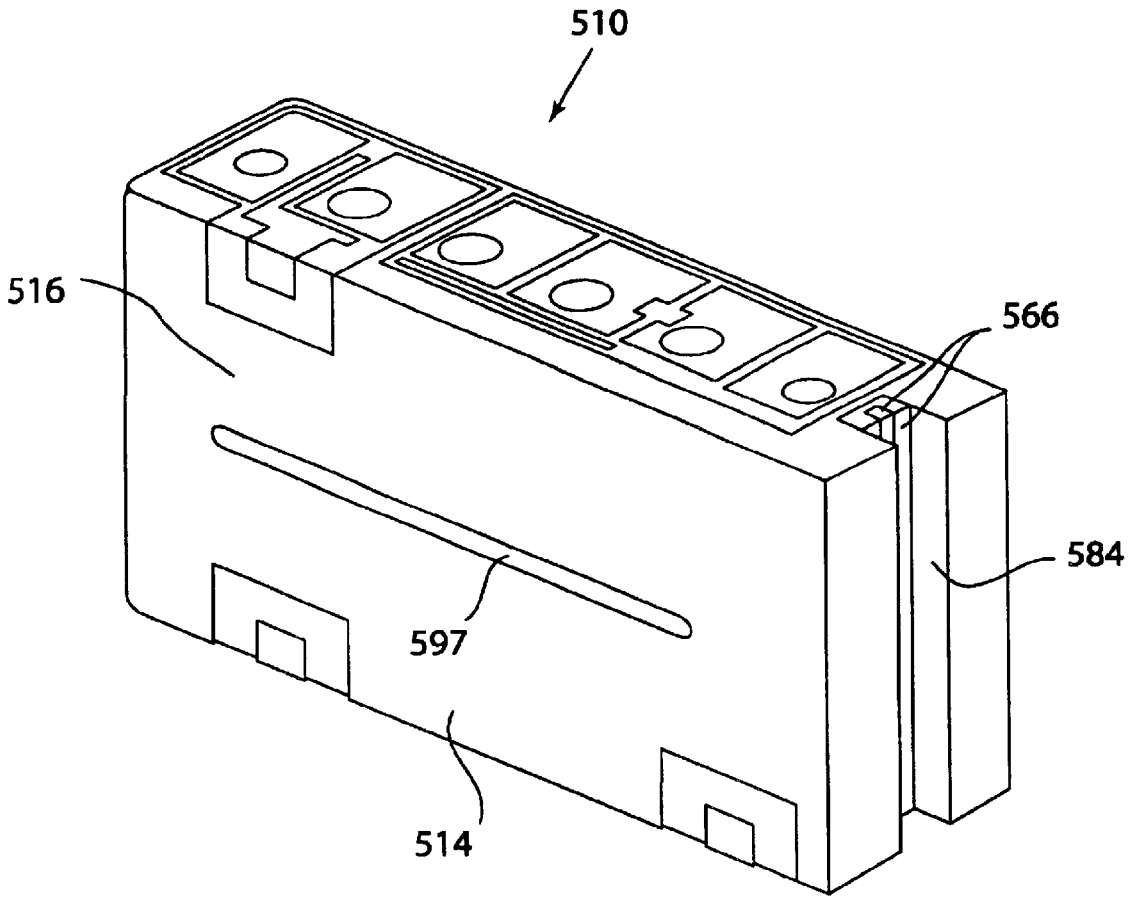
FIG. 16 is a perspective view of a duplexing communication filter according to another alternate embodiment of the invention.

The in-groove bridge electrode feature shown in FIGS. 10 and 11 is applicable to the slot divided core configuration of FIGS. 14 and 15. This combination of inventive features is shown in FIG. 16 for a filter designated 510. Filter 510 Includes a core 512 having a dividing passage (or slot) 597, a first, transmit portion 514, a second, receive portion 516, and a surface groove 584 bearing a bridge electrode 566.

EXAMPLE

Figure 17:
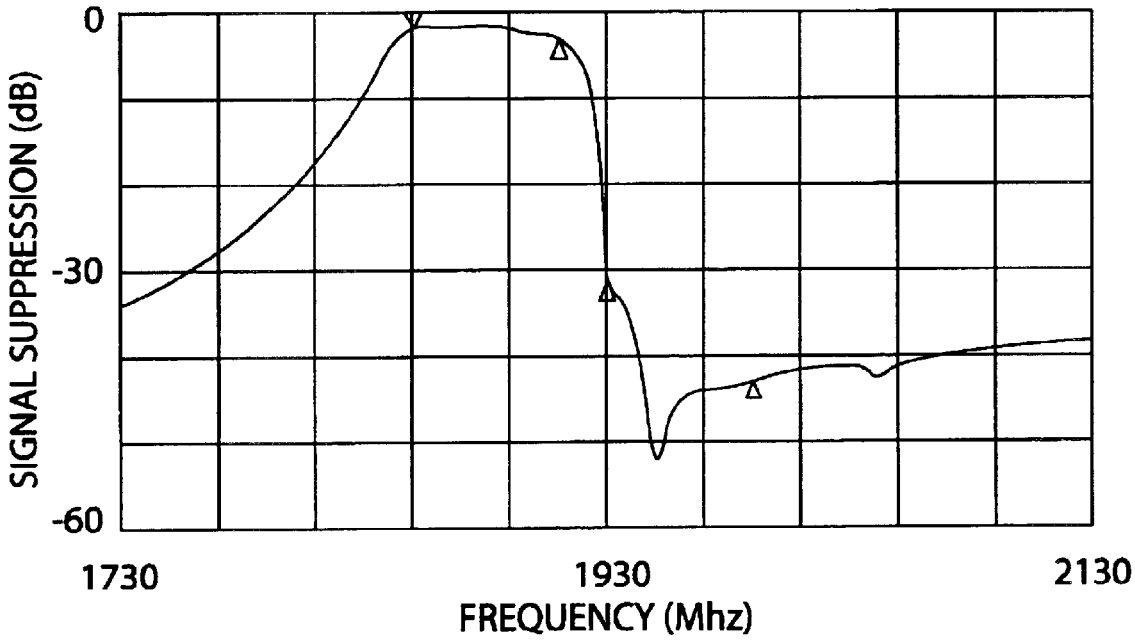
FIG. 17 is a transmitter signal frequency response graph ($S_{21}$) for a filter according to FIG. 1.
Figure 18:
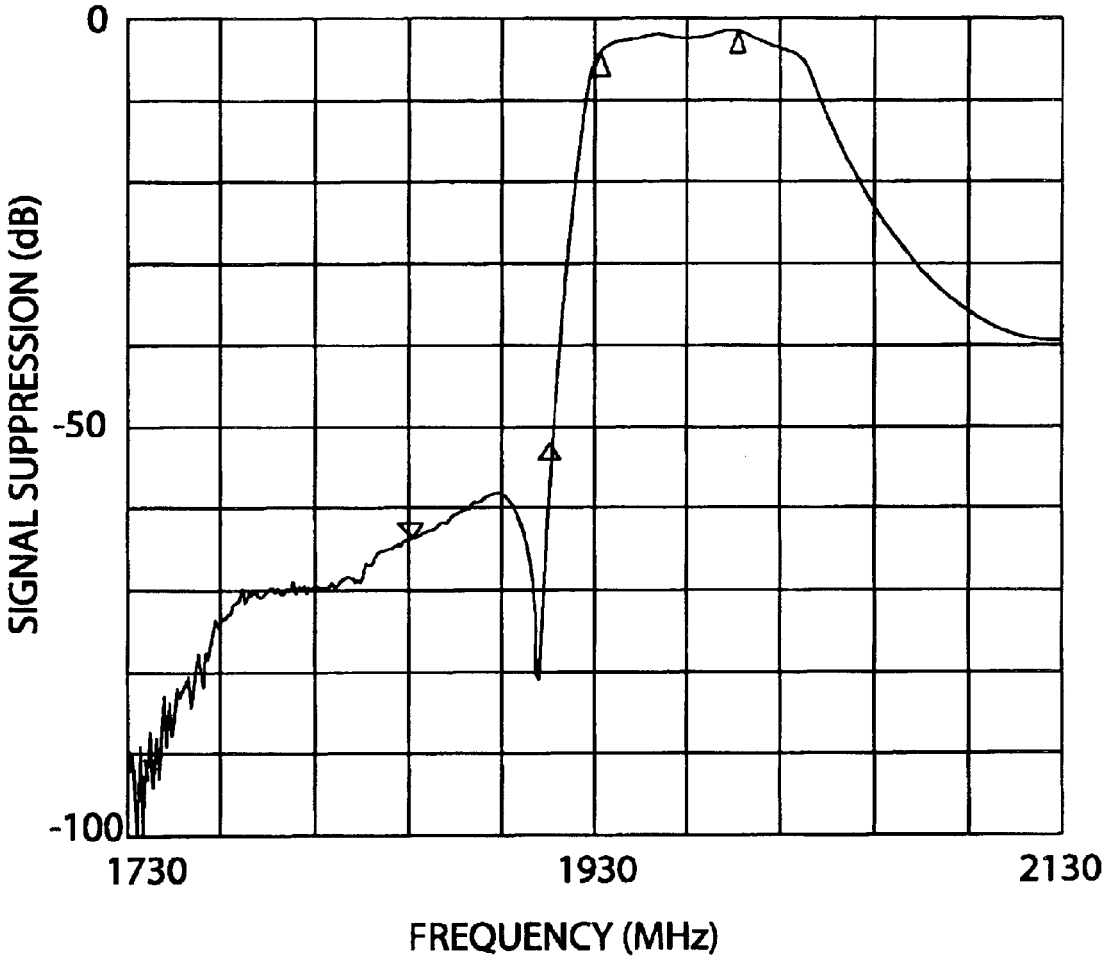
FIG. 18 is a receiver signal frequency response graph ($S_{21}$) for a filter according to FIG. 1.

A batch of filters according to the embodiment shown in FIGS. 1 through 8 were fabricated and tested. FIG. 17 is a response graph for a signal passing between transmit contact 60 and antenna contact 64. FIG. 18 is a response graph for a signal passing between antenna contact 64 and receive contact 62.

More specifically, FIGS. 17 and 18 are graphs of type 21 Scattering Parameters ($S_{21}$). Scattering Parameters were defined and related testing methods were developed to address the complexity of measuring and comparing electric devices for high frequency applications. S-parameters are ratios of reflected and transmitted traveling waves measured at specified component connection points. An $S_{21}$ plot is a measure of insertion loss, a ratio of an output signal at an output connection to an input signal at an input connection.

FIGS. 17 and 18 were generated using a network analyzer. For a discussion of Scattering Parameters and associated test standards and equipment, please consult the following references: Anderson, Richard W. "S-Parameter Techniques for Faster, More Accurate Network Design," Hewlett-Packard Journal. vol. 18, no. 6, February 1967; Weinert, "Scattering Parameters Speed Design of High Frequency Transistor Circuits," Electronics, vol. 39, no. 18, Sept. 5, 1986; or Bodway, "Twoport Power Flow Analysis Using Generalized Scattering Parameters," Microwave Journal, vol. 10, no. 6, May 1967.

As revealed by FIGS. 17 and 18, the fabricated filters exhibited a transmit passband of 1850 to 1910 Megahertz and a receive passband of 1930 to 1990 Megahertz. Noteworthy from FIG. 17 is the maximum transmit passband insertion loss of 2.51 decibels (dB).

A key feature of the present invention is a reduced maximum linear dimension as compared to parallelepiped shaped filters having comparable passbands. For example, a parallelepiped shaped filter commercially available from CTS Wireless Components (Albuquerque, N.Mex.) has equivalent passbands and a maximum linear dimension of 28.2 millimeters (mm). The fabricated example filters had a board height of 3.9 millimeters (mm) (reference numeral 92 in FIG. 1), a length of 15 millimeters (mm) (reference numeral 93) and a width of 10.8 millimeters (mm) (reference numeral 94). Each arm 14 and 16 has a width of 5.2 millimeters (reference numeral 95) and a length of 12.6 millimeters (mm) (reference numeral 96). Filters according to the present invention are especially suited for use in electronic devices having special requirements for filter maximum dimensions.

Numerous variations and modifications of the embodiments described above may be effected without departing from the spirit and scope of the novel features of the invention. It is to be understood that no limitations with respect to the specific system illustrated herein are intended or should be inferred. It is, of course, intended to cover by the appended claims all such modifications as fall within the scope of the claims.

What is claimed is:

1. A duplexing communication signal filter for connection to an antenna, a transmitter and a receiver, the signal filter suitable for filtering an incoming signal from the antenna to the receiver and for filtering an outgoing signal from the transmitter to the antenna, the filter comprising:

a substantially U-shaped core of dielectric material including a transmit arm, a receive arm and a base portion joining the transmit arm to the receive arm, each arm having an inwardly facing surface and an outwardly facing surface and each arm defining a series of through-holes, each through-hole extending through the arm between an opening at the inwardly facing surface and an opening at the outwardly facing surface; and a pattern of metallized and unmetallized areas on the core including, a wide area of metallization, a first unmetallized area surrounding a plurality of the through-hole openings on the outwardly facing surface of the transmit arm, a second unmetallized area surrounding a plurality of the through-hole openings on the outwardly facing surface of the receive arm, a transmitter pad metallized area on the transmit arm for receiving the outgoing signal, a receiver pad metallized area on the receive arm for providing the incoming signal, an antenna pad metallized area on the base portion for receiving the incoming signal and outputting the outgoing signal, a bridge metallized area extending between the transmit arm and the receive arm, and a bridge through-hole extending between the transmit arm outwardly facing surface and the receive arm outwardly facing surface, the bridge through-hole having side walls and the bridge metallized area being present on the side walls of the bridge through-hole.

2. The filter according to claim 1 exhibiting a filtering passband for the outgoing signal from about 1850 MHz to about 1910 MHz and exhibiting filtering passband for the incoming signal from about 1930 MHz to about 1990 MHz.

3. The filter according to claim 2 with a length of at most about 17 millimeters.

4. The filter according to claim 2 with a surface mount height of at most about 4 millimeters.

5. The filter according to claim 1 exhibiting a filtering passband for the outgoing signal of about 1850 MHz to about 1910 MHz with an ambient temperature maximum insertion loss over the outgoing signal passband of at most about 2.51 decibels (dB).

6. The filter according to claim 1 exhibiting a filtering passband for the incoming signal from about 1930 MHz to about 1990 MHz.

7. The filter according to claim 1 having a length of at most about 17 millimeters.

8. The filter according to claim 1 wherein the antenna pad is positioned on the base portion towards the transmit arm.

9. The filter according to claim 1 wherein the antenna pad is positioned on the base portion towards the receive arm.

10. The filter according to claim 1 wherein the transmitter pad is spaced apart from the base portion along a length of the transmit arm.

11. The filter according to claim 1 wherein the receiver pad is spaced apart from the antenna pad along a length of the receive arm.

12. The filter according to claim 1 wherein the transmit arm has a base side and an opposing distal end and the transmitter pad is positioned such that at least one of the through-holes is present between the transmitter pad and the distal end.

13. The filter according to claim 1 wherein the transmit arm includes at least one through-hole configured to be a signal trapping resonator.

14. The filter according to claim 1 wherein the receive arm includes at least one through-hole configured to be a signal trapping resonator.

15. The filter according to claim 1 wherein the transmit arm outwardly facing surface has a metallization pattern.

16. The filter according to claim 1 wherein the receive arm outwardly facing surface has a metallization pattern.

17. The filter according to claim 1 wherein the series of through-holes defined by the transmit arm are each axially aligned with the series of through-holes defined by the receive arm.

* * * * *